US006482562B2

(12) United States Patent
Ezenyilimba et al.

(10) Patent No.: US 6,482,562 B2
(45) Date of Patent: Nov. 19, 2002

(54) TONER PARTICLES OF CONTROLLED MORPHOLOGY

(75) Inventors: Matthew C. Ezenyilimba, Rochester, NY (US); Michael T. Regan, Fairport, NY (US); Todd C. Zion, Rochester, NY (US); Dennis E. Smith, Rochester, NY (US); Hichang Yoon, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/944,583

(22) Filed: Aug. 31, 2001

(65) Prior Publication Data

US 2002/0068233 A1 Jun. 6, 2002

Related U.S. Application Data

(63) Continuation-in-part of application No. 09/385,527, filed on Aug. 30, 1999, now abandoned, and a continuation-in-part of application No. 09/265,750, filed on Mar. 10, 1999, now Pat. No. 6,207,338.

(51) Int. Cl.[7] ..... G03G 9/08
(52) U.S. Cl. ..... 430/137.14; 430/137.1
(58) Field of Search ..... 430/137.1, 137.14, 430/137.19, 137

(56) References Cited

U.S. PATENT DOCUMENTS

| | | | | |
|---|---|---|---|---|
| 3,893,935 | A | 7/1975 | Jadwin et al. | |
| 4,079,014 | A | 3/1978 | Burness et al. | |
| 4,323,634 | A | 4/1982 | Jadwin | |
| 4,833,060 | A | 5/1989 | Nair et al. | |
| 5,059,580 | A * | 10/1991 | Shibata et al. | 503/227 |
| 5,283,151 | A | 2/1994 | Santilli | |
| 5,968,702 | A * | 10/1999 | Ezenyilimba et al. | 430/110.3 |
| 6,294,595 | B1 * | 9/2001 | Tyagi et al. | 523/333 |
| 6,380,297 | B1 * | 4/2002 | Zion et al. | 524/493 |

FOREIGN PATENT DOCUMENTS

| | | |
|---|---|---|
| GB | 1 420 839 | 1/1976 |

* cited by examiner

*Primary Examiner*—Janis L. Dote
(74) *Attorney, Agent, or Firm*—Chris P. Konkol

(57) ABSTRACT

A method for the preparation of electrostatographic toner comprising the steps of: a) dissolving a polymer material in an organic solvent to form an organic phase; b) dispersing the organic phase in an aqueous phase comprising a particulate stabilizer to form a dispersion and homogenizing the resultant dispersion wherein a flocculating agent is added to the aqueous phase before or after homogenization; c) evaporating the organic solvent and recovering a resultant product; and d) washing and drying the resultant product.

13 Claims, No Drawings

TONER PARTICLES OF CONTROLLED MORPHOLOGY

CROSS-REFERENCE TO RELATED APPLICATION

This is a continuation-in-part of a continuation-in-part application Ser. No. 09/385,527, filed Aug. 30,1999, now abandoned, entitled TONER PARTICLES OF CONTROLLED MORPHOLOGY by Matthew Ezenyilimba et al., which in turn is a continuation-in-part of application Ser. No. 09/265,750, filed Mar. 10, 1999, entitled TONER PARTICLES OF CONTROLLED MORPHOLOGY by Matthew Ezenyilimba and Michael Regan which is now U.S. Pat. No. 6,207,338, B1 that issued Mar. 27, 2001.

FIELD OF THE INVENTION

This invention relates to a method for the preparation of polymeric particles suitable for use as electrostatographic toner, and more particularly, to a method for the preparation of toner particles of controlled shape in which flocculating agents are employed for controlling morphology of the toner particles.

BACKGROUND OF THE INVENTION

Electrostatic toner polymer particles can be prepared by a process frequently referred to as "limited coalescence". In this process, polymer particles having a narrow size distribution are obtained by forming a solution of a polymer in a solvent that is immiscible with water, dispersing the solution so formed in an aqueous medium containing a solid colloidal stabilizer and removing the solvent by evaporation. The resultant particles are then isolated, washed and dried.

In the practice of this technique, toner particles are prepared from any type of polymer that is soluble in a solvent that is immiscible with water. Thus, the size and size distribution of the resulting particles can be predetermined and controlled by the relative quantities of the particular polymer employed, the solvent, the quantity and size of the water insoluble solid particulate suspension stabilizer, typically silica or latex, and the size to which the solvent-polymer droplets are reduced by agitation.

Limited coalescence techniques of this type have been described in numerous patents pertaining to the preparation of electrostatic toner particles because such techniques typically result in the formation of toner particles having a substantially uniform size distribution. Representative limited coalescence processes employed in toner preparation are described in U.S. Pat. Nos. 4,833,060 and 4,965,131 to Nair et al.

U.S. Pat. No. 5,283,151 is representative of earlier work in this field and describes the use of carnauba wax to achieve similar toner morphology. The method comprises the steps of dissolving carnauba wax in ethyl acetate heated to a temperature of at least 75° C. and cooling the solution, so resulting in the precipitation of the wax in the form of very fine needles a few microns in length; recovering the wax needles and mixing them with a polymer material, a solvent and optionally a pigment and a charge control agent to form an organic phase; dispersing the organic phase in an aqueous phase comprising a particulate stabilizer and homogenizing the mixture; evaporating the solvent and washing and drying the resultant product.

Unfortunately, this technique requires the use of elevated temperature to dissolve the wax in the solvent and cooling the solution to precipitate the wax. The wax does not stay in solution of ethyl acetate at ambient temperature and as a result it is very difficult to scale up using this methodology.

The shapes of the toner particles have a bearing on the electrostatic toner transfer and cleaning properties. Thus, for example, the transfer and cleaning efficiency of toner particles have been found to improve as the sphericity of the particles are reduced. Thus far, workers in the art have long sought to modify the shape of the evaporative limited coalescence type toner particles by means other than the choice of pigment, binder, or charge agent. The shape of the toner particles are modified to enhance the cleaning and transfer properties of the toner.

SUMMARY OF THE INVENTION

In accordance with the present invention, the prior art limitations are effectively obviated by a novel process in which specified flocculating agents are introduced into the aqueous phase of the limited coalescence process. The use of the flocculating agents result in the formation of non-spherical toner particles after the solvent is removed. The toner morphology is controlled independently of the toner composition (i.e. resin, binder matrix, pigment, charge control agent, etc.). The degree of non-sphericity is directly related to the concentration of flocculating agent.

Thus, viewed from one aspect, the present invention is directed to a method for the preparation of electrostatographic toner comprising the steps of:

a) dissolving a polymer material and optionally a pigment and a charge control agent in an organic solvent to form an organic phase;

b) dispersing the organic phase in an aqueous phase comprising a particulate stabilizer and optionally a promoter to form a dispersion and homogenizing the resultant dispersion wherein a flocculating agent is added to the aqueous phase either before or after homogenation;

c) evaporating the organic solvent and recovering a resultant product; and d) washing and drying the resultant product.

Viewed from another aspect, the present invention is directed to a process for preparing electrophotographic toner by dispersing an organic phase in an aqueous phase to yield a layer of particulate suspension stabilizer on the surface of the polymer. The improvement in the process comprises adding the flocculating agent, particulate stabilizer and promoter to the aqueous phase in the aforementioned limited coalescence process.

It is an advantage of the present invention that elevated temperatures are not needed. It is also an advantage that the flocculating agents are water soluble or water dispersible and so it is relatively easy to scale up production.

These and other features and advantages of the present invention will be better understood taken in conjunction with the following detailed description and claims.

DETAILED DESCRIPTION OF THE INVENTION

In accordance with the present invention, a pigment dispersion is prepared by conventional techniques as, for example, by media milling, melt dispersion and the like. The pigment dispersion, polymer material, a solvent and optionally a charge control agent are combined to form an organic phase. This mixture is permitted to stir overnight and then dispersed in an aqueous phase comprising a particulate stabilizer and optionally a promoter.

The resultant mixture is then subjected to mixing and homogenization. The flocculating agent is added to the aqueous phase either before or after mixing/homogenization. In this process, the particulate stabilizer forms an interface between the organic globules in the organic phase. Due to the high surface area associated with small particles, the coverage by the particulate stabilizer is not complete. Coalescence continues until the surface is completely covered by particulate stabilizer. Thereafter, no further growth of the particles occurs. Accordingly, the amount of the particulate stabilizer is inversely proportional to the size of the toner obtained. The relationship between the aqueous phase and the organic phase, by volume may range from 1:1 to approximately 9:1. This indicates that the organic phase is typically present in an amount from about 10% to 50% of the total homogenized volume.

Following the homogenization treatment, the solvent present is removed by evaporation or boiling, optionally under vacuum, and the resultant product washed and dried.

The solvents chosen for use in the organic phase steps may be selected from among any of the well-known solvents capable of dissolving polymers. Typical of the solvents chosen for this purpose are chloromethane, dichloromethane, ethyl acetate, vinyl chloride, n-propyl acetate, iso-propyl acetate, trichloromethane, carbon tetrachloride, ethylene chloride, trichloroethane, toluene, xylene, cyclohexanone, 2-nitropropane and the like.

The particulate stabilizer selected for use herein may be selected from among highly cross-linked polymeric latex materials of the type described in U.S. Pat. No. 4,965,131 to Nair et al., or silicon dioxide. Silicon dioxide is preferred. It is generally used in an amount ranging from 1 to 15 parts, by weight, based on 100 parts of the total solids in the toner. The size and concentration of these stabilizers control and predetermine the size of the final toner particles. In other words, the smaller the size and/or the higher the concentration of such particles, the smaller the size of the final toner particles.

Any suitable promoter that is water soluble and affects the hydrophilic/hydrophobic balance of the solid dispersing agent in the aqueous solution may be employed in order to drive the solid dispersing agent, that is, the particulate stabilizer, to the polymer/solvent droplet-water interface. Typical of such promoters are sulfonated polystyrenes, alginates, carboxy methylcellulose, tetramethyl ammonium hydroxide or chloride, diethylaminoethylmethacrylate, water-soluble complex resinous amine condensation products of ethylene oxide, urea and formaldehyde and polyethyleneimine. Also effective for this purpose are gelatin, casein, albumin, gluten and the like or non-ionic materials such as methoxycellulose. The promoter is generally used in an amount from about 0.2 to about 0.6 parts per 100 parts of aqueous solution by weight.

Various additives generally present in electrostatographic toner may be added to the polymer prior to dissolution in the solvent or in the dissolution step itself, such as charge control agents, waxes and lubricants. Suitable charge control agents are disclosed, for example, in U.S. Pat. Nos. 3,893,935 and 4,323,634 to Jadwin et al., U.S. Pat. No. 4,079,014 to Burness et al. and British Patent No. 1,420,839 to Eastman Kodak. Charge control agents are generally employed in small quantities such as from about 0 to 10 parts per hundred based upon the weight of the total solids content (weight of the toner) and preferably from about 0.2 to about 3.0 parts per hundred.

As indicated, the present invention is applicable to the preparation of polymeric toner particles from any type of polymer that is capable of being dissolved in a solvent that is immiscible with water and includes compositions such as, for example, olefin homopolymers and copolymers, such as, polyethylene, polypropylene, polyisobutylene and polyisopentylene; polytrifluoroolefins; polytetrafluoroethylene and polytrifluorochloroethylene; polyamides, such as polyhexamethylene adipamide, polyhexamethylene sebacamide, and polycaprolactam; acrylic resins, such as polymethylmethacrylate, polymethylacrylate, polyethylmethacrylate and styrene-methylmethacrylate; ethylene-methylacrylate copolymers, ethylene-ethyl acrylate copolymers, ethylene-ethyl methacrylate copolymers, polystyrene and copolymers of styrene with unsaturated monomers such as butyl acrylate-styrene copolymer, cellulose derivatives, polyesters, polyvinyl resins and ethylene-vinyl alcohol copolymers and the like. Preferably, the polymer material is polyester or butyl acrylate-styrene copolymer.

Pigments suitable for use in the practice of the present invention should be capable of being dispersed in the polymer, insoluble in water and yield strong permanent color. Typical of such pigments are the organic pigments such as phthalocyanines, lithols and the like and inorganic pigments such as $TiO_2$, carbon black and the like. Typical of the phthalocyanine pigments are copper phthalocyanine, a mono-chloro copper phthalocyanine, and hexadecachloro copper phthalocyanine. Other organic pigments suitable for use herein include anthraquinone vat pigments such as vat yellow 6GLCL1127, quinone yellow 18-1, indanthrone CL1106, pyranthrone CL1096, brominated pyranthrones such as dibromopyranthrone, vat brilliant orange RK, anthramide brown CL1151, dibenzanthrone green CL1101, flavanthrone yellow CL1118; azo pigments such as toluidine red C169 and hansa yellow; and metallized pigments such as azo yellow and permanent red. The carbon black may be any of the known types such as channel black, furnace black, acetylene black, thermal black, lamp black and aniline black. The pigments are employed in an amount sufficient to give a content thereof in the toner from about 1% to 40%, by weight, based upon the weight of the toner, and preferably within the range of 4% to 20%, by weight.

Flocculating agents are listed in detail in the book "The Chemistry of Silica" by R. K. Iler (John Wiley & Sons, 1979, pp.384–396). Preferred flocculating agents suitable for use in the present invention include cationic surfactants, basic metal salts, cationic polymers and inorganic colloids. The flocculating agent may comprise 0.0001–50% by weight of the total solids present in the organic phase.

Preferred cationic surfactants are ammonium salts having the general form,

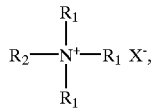

where X may be $H_2PO_4$, OH, Br or Cl, each $R_1$ may be individually selected from the form $—(CH_2)_nY$, where Y may be either

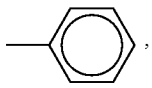

—OH or —H, and $R_2$ has the form $—(CH_2)_pZ$, where Z may be —H or $—NHOOC(CH_2)_pCH_3$, each n may be individually selected from the integers ranging from 0 to 5, and each p may be individually selected from the integers ranging from 0 to 20. Typical of such materials are dodecyl ammonium chloride and octadecyl trimethyl ammonium bromide and long chain betaines like dodecyl betaine.

Additional preferred cationic surfactants are long chain pyridinium salts, wherein long chain is a hydrocarbon with 8 or more carbons in it, such as cetyl pyridinium bromide.

Additional preferred cationic surfactants are ammonium salts having the general form, $R—(O—CH(CH_3)—CH_2)_n—O—R$, where each R is individually selected from $—CH_2—CH(N^+(R_1)_3)—CH_3\ X^-$ or $—CH_2—CH_2—O—CH_3$, but at least one of R is $—CH_2—CH\ (N^+(R_1)_3)—CH_3\ X^-$, where each $R_1$ may be individually selected from —H or $—(CH_2)_m—CH_3$ where m is selected from integers 0 to 3 and X is elected from $H_2PO_4$, Cl or Br, where n is selected from integers 3 to 50.

Additional preferred cationic surfactants are ammonium salts having the general form:

$$R—(O—CH(CH_3)—CH_2)_n—(O—CH2—CH2)_m—(O—CH(CH_3)—CH_2)_n—O—R,$$

where each R is individually selected from $—CH_2—CH(N^+(R_1)_3)—CH_3\ X^-$ or $—CH_2—CH_2—O—CH_3$, but at least one of R is $—CH_2—CH\ (N^+(R_1)_3)—CH_3\ X^-$, where each $R_1$ may be individually selected from —H or $—(CH_2)_p—CH_3$ where p is selected from integers 0 to 3 and X is elected from $H_2PO_4$, Cl or Br, where each n and m are individually selected from integers 2–30.

Preferred basic metal salts are aluminum salts such as aluminum chloride, aluminum acetate, aluminum acetylacetonate.

Additional preferred basic metal salts are gallium(III) salts such as gallium(III) bromide and gallium(III) chloride, gallium(III) acetylacetonate.

Preferred cationic polymers are homopolymers or (meth) acrylates copolymers of quaternary ammonium substituted (meth)acrylates such as poly(meth) acrylyloxyethyldiethylmethylammonium Bromide.

Additional preferred cationic polymers are polyvinylpyridinium salts such as poly(2-methyl-5-vinylpyridium halide) and ply(N-methyl-4-vinylpyridinium bromide).

Additional preferred cationic polymers are copolymers of acrylamide and a cationic monomer like N-phenyl-2-vinylpyridinium bromide.

Additional preferred cationic polymers are cationic linear or branched polyethyleneimine at pH <6.

Additional preferred cationic polymers are the products of the condensation polymerization between one or more dicarboxylic acids and an aminoalcohol, diamine, or diol, wherein at least one of the groups contained in one of the organic dicarboxylic acid chains carries a positive charge. Such cationic polymers have the general form,

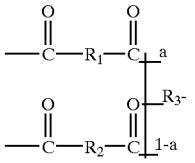

where $R_1$ may be $(CH_2)_n$ or

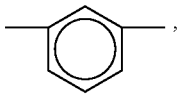

$R_2$ is phenylmethylphosphonium 4,4'-benzamide p-toluenesulfonate or triphenylmethylphosphonium p-toluenesulfonate, $R_3$ may be chosen from the following:

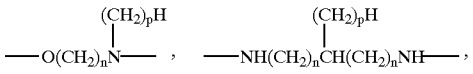

$—O(CH_2)_nO(CH_2)_nO—$, or

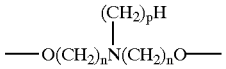

where each n may be independently selected from the integers ranging from 1 to 8, each p may be independently chosen from the integers ranging from 0 to 5, and a ranges from 0.00–0.99.

Preferred inorganic colloids are colloidal alumina and any colloidal silica with opposite charge of colloidal silica used as a stabilizer in the present invention such as positively charged LUDOX CL® silica or negatively charged NALCOAG 1060® silica.

A spherical particle is well known and is defined as a three dimensional object which has all points on the surface essentially equidistant from a central point. By non-spherical particle is meant a three dimensional object in which individual points on the surface have varying distances from a central point. This will be seen as irregular, or oblong, or wrinkled shapes and surfaces.

The invention will be more fully understood by reference to the following exemplary embodiment, which is set forth solely for purposes of exposition and is not to be construed as limiting. Unless otherwise indicated all percentages are by weight.

Comparative Example I

A media milled dispersion of HOSTAPERM pink pigment (manufactured by Hoechst Celanese) was prepared from a mixture of 91.0 g of the HOSTAPERM pink pigment, 9.0 g of commercially available styrene butylacrylate polymer (PICCOTONER® 1221) in 670.0 g of ethyl acetate (13.0% solids of mixture). To 14.8 g of the above media milled dispersion were then added 23.1 g of KAO C polyester binder and 45.5 g of ethyl acetate. This mixture was comprised of 7.0% pigment and 93.0% binder based on the total weight of pigment and binder and comprised the organic phase in the evaporative limited coalescence process. The organic phase was then mixed with an aqueous phase comprising 85 ml of pH4 buffer containing 9.0 g of NALCO® 1060 colloidal silica and 1.96 ml of 10% poly (adipic acid-comethylaminoethanol). This mixture was then subjected to very high shear using a POLYTRON mixer sold by Brinkman followed by a MICROFLUIDIZER mixer. Upon exiting, the solvent was removed from the particles so formed by stirring overnight at room temperature in an open container. These particles were washed with 0.1N potassium hydroxide solution to remove the silica followed by water and dried. The toner particles were of the order of 6.5$\mu$ volume average and entirely spherical.

Comparative Example II

The procedure of Comparative Example I was repeated with the exception that bridged aluminum phthalocyanine/copper phthalocyanine pigments manufactured by Eastman Kodak and BASF, respectively, replaced the magenta pigment. The resultant particles were spherical and particle size was 6.8$\mu$.

Comparative Example III

The procedure of Comparative Example I was repeated with the exception that the magenta pigment was replaced by Pigment Yellow 180 manufactured by BASF. The resultant particles were spherical and particle size was6.4$\mu$.

Comparative IV

The procedure of Comparative Example I was repeated with the exception that the magenta pigment was replaced by carbon black (REGAL 330) manufactured by CABOT. The resultant particles were completely spherical and particle size was 6.7$\mu$.

Comparative V

To 1,212.0 g of ethyl acetate was added 303.0 g of commercially available polyester-based polymer KAO P, and the resulting mixture was allowed to stir overnight. To 750.0 g of the organic phase was added an aqueous phase comprising 2,240.6 g of pH4 buffer containing 50.4 g of LUDOX® TM (colloidal silica from DuPont) and 10.8 g of 10% poly (adipic acid-co-methylaminoethanol). This mixture was stirred using a pitched-blade turbine laboratory agitator at 400 RPM for five minutes and then passed through a GAULIN homogenizer at 350 kg/cm$^2$. Upon exiting, 655.0 g of the homogenized mixture was stirred overnight at room temperature in an open container to remove the solvent. The resulting particles were spherical, approximately 4.5 $\mu$m in diameter and had a narrow particle size distribution.

EXAMPLE 1

Additional examples using a variety of flocculating agents are disclosed in commonly assigned U.S. Ser. No. 09/373,340, now U.S. Pat. No. 6,380,297 incorporated by reference herein in its entirety. This latter reference uses a modified method wherein the flocculating agent is added after homogenization, but the flocculating agents are useful when they are added before homogenation.

EXAMPLE 2

To 14.8 g of the HOSTAPERM pink pigment media milled dispersion were then added 23.1 g of KAO C binder and 45.5 g of ethyl acetate. This mixture was comprised of 7.0% pigment and 93.0% binder based on the total weight of pigment and binder and comprised the organic phase in the evaporative limited coalescence process. The organic phase was then mixed with an aqueous phase comprising 85 ml of pH4 buffer containing 0.0625 g of aluminium acetate (0.25%), 9.0 g of NALCO® 1060 colloidal silica and 1.96 ml of 10% poly (adipic acid-comethylaminoethanol). This mixture was then subjected to very high shear using a POLYTRON mixer sold by Brinkman followed by a MICROFLUIDIZER mixer. Upon exiting, the solvent was removed from the particles so formed by stirring overnight at room temperature in an open container. These particles were washed with 0.1N potassium hydroxide solution to remove the silica followed by water and dried. The toner particles were of the order of 5.8$\mu$ volume average and entirely non-spherical.

EXAMPLE 3

The procedure of Example 2 was repeated with the exception that 0.125 g of aluminum acetate (0.5%) was added. The resultant particles were completely non-spherical and particle size was 5.2$\mu$.

EXAMPLE 4

The procedure of Example 2 was repeated with the exception that 0.25 g of aluminum acetate (1.0%) was added. The resultant particles were completely non-spherical and particle size was 6.0$\mu$.

EXAMPLE 5

The procedure of Example 2 was repeated with the exception that magenta pigment was replaced with bridged aluminum phthalocyanine/copper phthalocyanine pigment mixture and 0.0625 g of aluminum acetate (0.25%) added. The resultant particles were completely non-spherical and particle size was 5.9$\mu$.

EXAMPLE 6

The procedure of Example 5 was repeated with the exception that 0.25 g of aluminum acetate (1.0%) was added. The resultant particles were completely non-spherical and particle size was 6.1$\mu$.

EXAMPLE 7

The procedure of Example 2 was repeated with the exception that magenta pigment was replaced with Pigment Yellow 180 and 0.25 g of aluminum acetate (1.0%) added. The resultant particles were completely non-spherical and particle size was 5.3$\mu$.

EXAMPLE 8

The procedure of Example 2 was repeated with the exception that magenta pigment was replaced with REGAL 330 carbon black and 0.25 g of aluminum acetate (1.0%) added. The resultant particles were completely non-spherical and particle size was 4.5$\mu$.

EXAMPLE 9

The procedure of Example 2 was repeated with the exception that the pigment was omitted from the mixture and 0.25 g of aluminum acetate (1.0%) added. The resultant particles were completely non-spherical and particle size was 5.3$\mu$.

EXAMPLE 10

To 14.8 g of the HOSTAPERM pink pigment media milled dispersion were then added 23.1 g of KAO C binder, 0.25 g of BONTRON E88 charge additive and 45.5 g of ethyl acetate. This mixture was comprised of 7.0% pigment and 93.0% binder based on the total weight of pigment and binder and comprised the organic phase in the evaporative limited coalescence process. The organic phase was then mixed with an aqueous phase comprising 85 ml of pH4 buffer containing 0.25 g of aluminum acetate (1.0%), 9.0 g of NALCO® 1060 colloidal silica and 1.96 ml of 10% poly (adipic acid-comethylaminoethanol). This mixture was then subjected to very high shear using a POLYTRON mixer sold by Brinkman followed by a MICROFLUIDIZER mixer. Upon exiting, the solvent was removed from the particles so formed by stirring overnight at room temperature in an open container. These particles were washed with 0.1N potassium hydroxide solution to remove the silica followed by water and dried. The toner particles were of the order of 6.2$\mu$ volume average and entirely non-spherical.

EXAMPLE 11

The procedure of Example 10 was repeated with the exception that magenta pigment was replaced with bridged aluminum phthalocyanine/copper phthalocyanine pigment mixture. The resultant particles were completely non-spherical and particle size was 6.4$\mu$.

EXAMPLE 12

The procedure of Example 10 was repeated with the exception that magenta pigment was replaced with Pigment Yellow 180. The resultant particles were completely non-spherical and particle size was 5.0$\mu$.

EXAMPLE 13

The procedure of Example 10 was repeated with the exception that magenta pigment was replaced with REGAL 330, carbon black. The resultant particles were completely non-spherical and particle size was 3.7$\mu$.

EXAMPLE 14

The procedure of Example 10 was repeated with the exception that the pigment was omitted from the mixture. The resultant particles were completely non-spherical and particle size was 5.0$\mu$.

EXAMPLE 15

To 14.8 g of the HOSTAPERM pink pigment media milled dispersion were then added 23.1 g of KAO C binder, 0.25 g of BONTRON E88 charge additive (manufactured by Orient Chemical Industries, Ltd.) and 45.5 g of ethyl acetate. This mixture was comprised of 7.0% pigment and 93.0% binder based on the total weight of pigment and binder and comprised the organic phase in the evaporative limited coalescence process. The organic phase was then mixed with an aqueous phase comprising 85 ml of pH4 buffer containing 0.25 g of aluminum acetylacetonate (1.0%), 9.0 g of NALCO® 1060 colloidal silica and 1.96 ml of 10% poly (adipic acid-comethylaminoethanol). This mixture was then subjected to very high shear using a POLYTRON mixer sold by Brinkman followed by a MICROFLUIDIZER mixer. Upon exiting, the solvent was removed from the particles so formed by stirring overnight at room temperature in an open container. These particles were washed with 0.1N potassium hydroxide solution to remove the silica followed by water and dried. The toner particles were of the order of 5.3$\mu$ volume average and entirely non-spherical.

EXAMPLE 16

The procedure of Example 15 was repeated with the exception that aluminum acetylacetonate was replaced with gallium acetylacetonate. The resultant particles were completely non-spherical and the particle size was 4.9$\mu$.

TABLE 1

| Specific Surface Area ($m^2/g$) | |
|---|---|
| Example | BET Value ($m^2/g$) |
| Comparative I | 0.83 |
| Comparative II | 0.93 |
| Comparative IV | 0.95 |
| Comparative III | 0.97 |
| Example 15 | 1.34 |
| Example 4 | 1.51 |
| Example 5 | 1.61 |
| Example 10 | 1.63 |
| Example 2 | 1.66 |
| Example 6 | 1.68 |
| Example 11 | 1.74 |
| Example 16 | 1.74 |
| Example 3 | 1.82 |
| Example 9 | 1.94 |
| Example 8 | 1.96 |
| Example 14 | 2.01 |
| Example 7 | 2.02 |
| Example 12 | 2.02 |
| Example 13 | 2.09 |

The BET results tabulated above support the present claim of controlling the toner morphology by the introduction of flocculating agents. BET value of approximately 1.00 $m^2/g$ denotes sphericity in the toner as is illustrated in comparative I, II, III, IV and V. BET values were calculated according to P. Chenebault and A. Schrenkamper, THE MEASUREMENT OF SMALL SURFACE AREAS BY THE B.E.T. ADSORPTION METHOD, The Journal of Physical Chemistry, Volume 69, Number 7, July 1965, pages 2300–2305.

The invention has been described in detail with particular reference to certain preferred embodiments thereof, but it will be understood that variations and modifications can be effected within the spirit and scope of the invention.

What is claimed is:

1. A method for the preparation of electrostatographic toner comprising the steps of:

A) dissolving a polymer material in an organic solvent to form an organic phase;

B) dispersing the organic phase in an aqueous phase comprising a flocculating agent and a particulate stabilizer to form a dispersion and homogenizing the resultant dispersion, wherein the particulate stabilizer is selected from the group consisting of highly cross-linked latex polymeric material, and $SiO_2$ and wherein flocculating agent is a cationic compound that is an ammonium salt having the general form

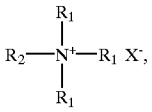

where X is $H_2PO_4$, OH, or Cl, each $R_1$ is individually selected from the form $(CH_2)_nY$, where Y is either

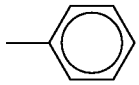

or —H, and $R_2$ has the form $(CH_2)_nZ$, where Z is —NHOOC$(CH_2)_pCH_3$, each n is individually selected from the integers ranging from 0 to 5, and each p is individually selected from an integer from 0 to 20; or said cationic flocculating agent is a product of condensation polymerization between one or more dicarboxylic acids and an aminoalcohol, diamine, or diol, wherein at least one group contained in an organic dicarboxylic acid chain carries a positive charge, thereby forming dispersed particles, and C) evaporating the organic solvent from the dispersed particles formed in step (B) and recovering resultant product.

2. The method of claim 1 wherein the polymer material is selected from the group consisting of polyethylene, polypropylene, polyisobutylene, polyisopentylene, polytrifluorolefins, polyamides, acrylic resins, ethylene-methylacrylate copolymers, ethylene-ethyl acrylate copolymers, ethylene-ethyl methacrylate copolymers, polystyrene and copolymers of styrene with unsaturated monomers, polyesters, polyvinyl resins and ethylene-vinyl alcohol copolymers.

3. The method of claim 1 wherein a charge control agent is added in step (A).

4. The method of claim 1 wherein a pigment is added in step (A).

5. The method of claim 1 wherein a promoter is added in the dispersing step in (B).

6. The method of claim 1 wherein the solvent is selected from the group consisting of chloromethane, dichloromethane, ethyl acetate, n-propyl acetate, iso-propyl acetate, vinyl chloride, trichloromethane, carbon tetrachloride, ethylene chloride, trichloroethane, toluene, xylene, cyclohexanone and 2-nitropropane.

7. The method of claim 1 wherein the amount of particulate stabilizer is between 1 to 15 parts based by weight on 100 parts of total solids in the toner.

8. The method of claim 1 wherein the ratio of the aqueous phase to the organic phase, by volume, ranges from 1:1 to. 9:1.

9. The method of claim 1 wherein the organic phase contains lubricants.

10. The method of claim 1 wherein the organic phase contains waxes.

11. The method of claim 1 wherein the polymer material is selected from the group consisting of polytetrafluoroethylene, polytrifluorochloroethylene, polyhexamethylene adipamide, polyhexamethylene sebacamide, polycaprolactam, polymethylmethacrylate, polymethylacrylate, polyethylmethacrylate and styrene-methylmethacrylate.

12. The method of claim 1 wherein the polymer material is polyester.

13. The method of claim 1 wherein the polymer material is butyl acrylate-styrene copolymer.

* * * * *